United States Patent [19]

Konwitza

[11] Patent Number: 4,598,928

[45] Date of Patent: Jul. 8, 1986

[54] RELEASE SKI BINDING

[75] Inventor: Vladimir Konwitza, Vienna, Austria

[73] Assignee: TMC Corporation, Baar, Switzerland

[21] Appl. No.: 572,101

[22] Filed: Jan. 19, 1984

[30] Foreign Application Priority Data

Jan. 21, 1983 [AT] Austria ..... 191/83

[51] Int. Cl.[4] ..... A63C 9/081

[52] U.S. Cl. ..... 280/618; 280/624

[58] Field of Search ..... 280/624, 618, 620, 617, 280/616, 636, 633

[56] References Cited

U.S. PATENT DOCUMENTS

| | | | |
|---|---|---|---|
| 3,477,736 | 11/1969 | Unger | 280/633 |
| 3,958,811 | 5/1976 | Sittmann | 280/618 |
| 3,963,253 | 6/1976 | Rieger | 280/617 |
| 4,113,276 | 9/1978 | Kirsch | 280/618 |
| 4,169,612 | 10/1979 | Kirsch | 280/636 |
| 4,352,508 | 10/1982 | Spademan | 280/624 |
| 4,394,032 | 7/1983 | Storandt et al. | 280/624 |

*Primary Examiner*—David M. Mitchell

*Attorney, Agent, or Firm*—Flynn, Thiel, Boutell & Tanis

[57] ABSTRACT

A release ski binding having a sole plate which is pivotal about a vertical axis and about a transverse axis, which sole plate is held on the ski by a resilient holding mechanism in the skiing position. The holding mechanism effects in response to a movement of the sole plate relative to the ski and upon reaching a predetermined angle of traverse, both an upwardly and also a side opening of a locking mechanism. The resilient holding mechanism is formed by a U-shaped spring member having a bearing thereon arranged in the region adjoining the legs of the U. The spring member is adjustable and securable in the longitudinal direction of the ski with respect to the locking mechanism. A sliding member is arranged between the legs of the U, which sliding member is secured to and movable with the sole plate.

18 Claims, 9 Drawing Figures

RELEASE SKI BINDING

FIELD OF THE INVENTION

This invention relates to a release ski binding having a sole plate which is pivotal about a vertical axis and about a transverse axis, which sole plate is held on the ski by a resilient holding mechanism in the skiing position, which holding mechanism effects, in response to a movement of the sole plate relative to the ski and upon reaching a predetermined angle of traverse, both an upwardly and also a side opening of a locking mechanism.

BACKGROUND OF THE INVENTION

Such release ski bindings are described in German Patent No. 2 533 337. In these conventional ski bindings the spring of the holding mechanism acts through a piston onto an approximately mushroom-shaped follower member, which is supported swingably to all sides in the housing of the holding mechanism. The stem portion of the mushroom-shaped follower member is received in a recess of a ski-fixed fitting. The ski shoe is, in these conventional ski bindings, held at its tip or toe by means of a rigid bar on the sole plate. The bar, however, prevents during a twisting fall the release of the ski shoe to a certain degree.

This disadvantage is avoided in the ski binding according to German Patent No. 2 324 078, however, this ski binding is very complicated in its design. In addition, in this ski binding the adjusting of the release moment is accomplished by two check nuts housed inside of the binding housing and, therefore, are accessible only after removing the housinglike front jaw from the ski. Therefore, the adjusting task can be accomplished only with difficulties.

The goal of the invention is to overcome the mentioned disadvantages of the conventional designs and to provide a release ski binding of the above-mentioned type, which is simple in its design and which can be adjusted easily externally of the ski binding to the desired release moment.

This goal is inventively attained primarily by providing a resilient holding mechanism being in the form of a U-shaped spring member having a bearing arranged in the region whereat the legs of the U are joined together. The spring member is securable as well as being adjustable in the longitudinal direction of the ski and with respect to the locking mechanism. The slide member is located between the legs of the spring member and is fastened to the sole plate at its upper end. Of course, the adjustment of the bearing could also occur against the action of a spring through a wedge or the like adjustable in the transverse direction of the ski as for example by a screw. However, it has been proven to be particularly advantageous to construct the bearing as a pin arranged on a travelling nut arranged on a screw which extends in the longitudinal direction of the ski. This enables it to be possible to adjust the desired release moment particularly sensitively.

Furthermore, the invention provides for the spring member to be arranged within a housing. The screw has at its end remote from the nut a part which is rotatably supported in a narrow sidewall of the housing, however, is secured against axial movement. The housing is secured below the sole plate on the ski. This measure ensures, on the one hand, a protected housing and an external accessibility of the screw located inside the housing and, on the other hand, preventing an undesired rotating of the screw under the influence of external forces. The further inventive characteristics lead also in this direction, namely, that for supporting the screw in the narrow sidewall of the housing the screw is provided with a flange and with a groove, whereby a snap ring is received in the groove, or that the screw is provided on its end projecting from the housing with a noncircular end, to facilitate engagement with a tool, such as a wrench.

In order to assure a reliable support of the spring member in all operating positions, it is inventively provided that the spring member is supported in the area of the free ends of its legs on a cross brace which extends transversely with respect to the longitudinal direction of the ski and parallel with respect to the upper surface of the ski, or that the spring member is centered in the skiing position of the ski binding relative to the vertical longitudinal center plane of the ski by a stop secured to the housing and extending between the ends of the two legs.

Actually it would by all means be possible to provide an enlarged head on the sliding member with semispherical projections, which engage correspondingly formed recesses in the legs of the spring member. However, it has proven to be particularly advantageous, if according to a further development of the invention the head of the sliding member has two upwardly converging surfaces with which are associated correspondingly formed surfaces on the underside of the two legs of the spring member.

In order to couple the spring member with the locking mechanism for the ski shoe, two plate-shaped control members for the control mechanism are arranged between the underside of the sole plate and the upper side of the housing, which control members are constructed as two-arm levers and are pivotal about a pin which is secured on the upper side of the housing and are coupled with the two legs of the spring member. Actually it would be possible to equip the control members with downwardly projecting pins extending through slotted holes in the upper side of the housing and being received in slotted holes, which extend in the transverse direction of the ski, in the two legs of the spring member. However, it has been proven as being particularly advantageous for the control members to have downwardly extending bent sections in the region of their arms adjacent the legs of the spring member, which bent sections extend through arc-shaped recesses in the upper side of the housing and rest on the outwardly facing sides of the two legs of the spring member. It is thereby preferable if the two control members are under the influence of a spring which urges the bent sections on the legs of the spring member together.

In order to assure a synchronous movement in opposite directions of the two control members during twisting falls, the invention includes the provision of link members hingedly connected to the arms of the control members having the bent sections thereon, which link members are connected by a pin guided in a slotted hole in the upper side of the housing and in a slot in a shoulder on the housing.

In order to hold the ski shoe on the sole plate, two pairs of bearing blocks are arranged on the end of the sole plate closest to the tip of the ski, on which bearing blocks are secured axles on which are supported angular or two-arm clamping jaws with slotted holes therein.

According to another characteristic of the invention, a control plate is guided in the vertical direction for movement between each pair of bearing blocks, which control plate has in its lower half a groove which opens toward the vertical longitudinal center plane of the ski and which is approximately trapezoidal in cross section. At least one projection is arranged on each control member, which projection extends into the groove in the skiing position of the ski binding. This characteristic of the invention contributes to a reliable locking of the clamping jaws in the skiing position. A further characteristic of the invention leads also in this direction, namely, that each clamping jaw has two recesses in the lower lever arm which lies opposite the clamping arm, of which recesses the one serves, in the skiing position of the ski binding, to receive a projection of the sole plate and the other one for receiving the upper end of the control plate. It is thereby preferable if each control plate is under the influence of a spring which urges it upwardly or if each clamping jaw has an outer surface which extends approximately parallel with respect to the longitudinal axis of the slotted hole, which outer surface serves as bearing surface for the upper end of the associated control plate in the stepping-in position of the ski binding.

Of course it would be possible to bring about the opening of the ski binding by a cam disk pivotal about an axis which is vertical on the upper side of the ski and which during manual rotation spreads apart the two control members. However, it has been proven as being preferable to provide an enlargement through which extends a bolt in the transverse direction of the ski, and to provide an axle arranged on the shoulder in a bearing block, on which axle is supported a two-arm release lever having a lower, U-shaped constructed arm resting on the ends of the bolt. This construction permits an opening of the ski binding by means of the ski pole, whereby the force which is needed for the opening is kept within the usual limits.

Finally it is preferable for the head of the sliding member to have on both sides thereof a groove which is wedge-shaped in cross section, into which, in the skiing position, is received a correspondingly formed leg of the spring member, which is approximately trapezoidal in cross section. This measure permits an opening of the ski binding during a backward fall of the skier.

BRIEF DESCRIPTION OF THE DRAWINGS

Two exemplary embodiments of an inventive release ski binding are illustrated in the drawings, in which.

DETAILED DESCRIPTION

Figure 1:
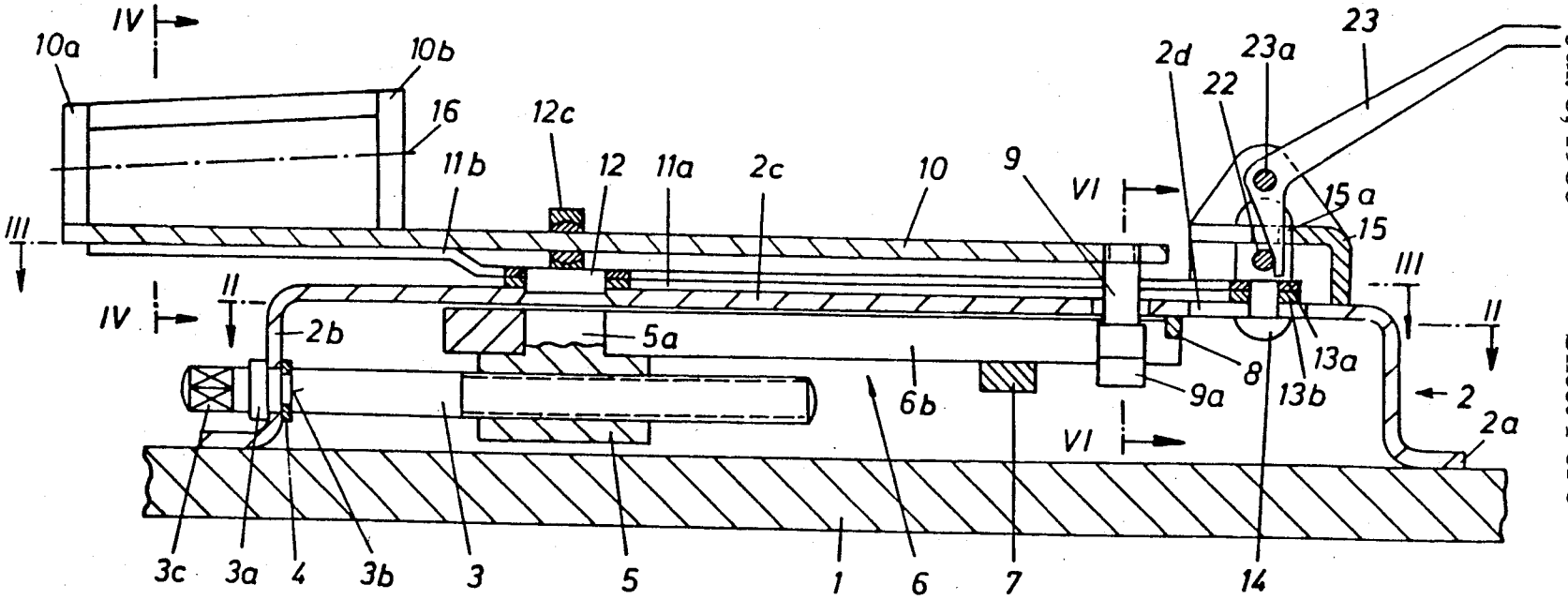
FIG. 1 is a cross-sectional view taken along the line I—I of FIG. 2 or FIG. 3 of the first embodiment.
Figure 2:
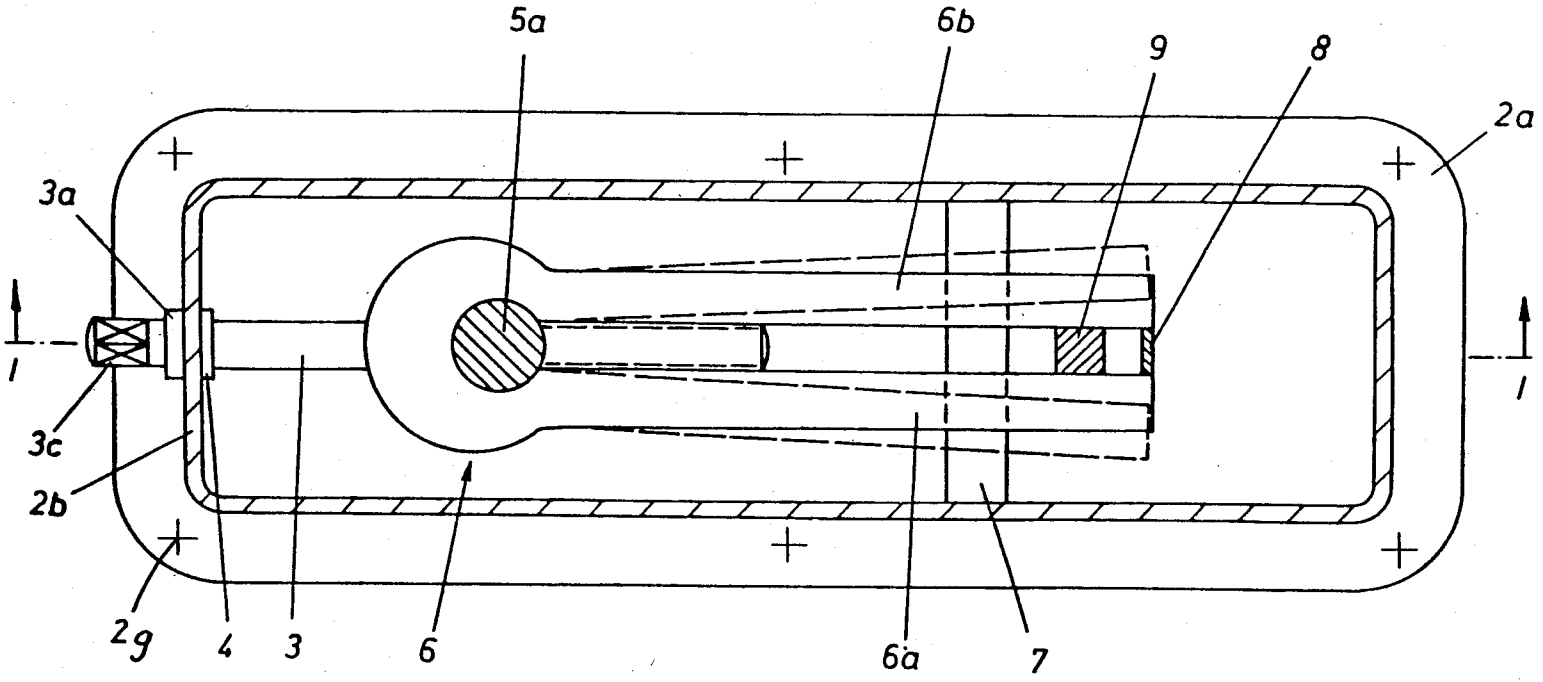
FIG. 2 is a cross-sectional view taken along the line II—II of FIG. 1.

A downwardly open, rectangularly shaped housing 2 is secured to the upper surface of a ski 1 for example by plural screws which extend through holes in a flange 2*a* encircling the housing. The screws are only schematically illustrated as at 2*g* in FIG. 2. A hole is provided in the narrow sidewall 2*b* of the housing 2 and rotatably supports a screw 3 therein, which screw is secured against axial movement. The screw 3 has for this purpose an annular flange or collar 3*a* thereon and an annular groove 3*b* axially spaced from the flange and into which is received a snap ring 4. The narrow sidewall 2*b* is received between the flange 3*a* and the snap ring 4. The axial end of the screw 3, which projects outwardly from the housing 2 has a square end 3*c* onto which a wrench, for example, a socket wrench (neither of which is illustrated), can be placed to facilitate rotating of the screw. The end of the screw 3 inside the housing has an externally threaded end thereon.

A nut 5 is threadedly arranged on the externally threaded portion of the screw 3 and has an upwardly projecting pin 5*a* thereon. An approximately U-shaped or hairpin shaped spring member 6 is attached to the pin 5*a*. The two legs 6*a*, 6*b* of the spring member 6 extend parallel with respect to the upper surface of the ski 1 and are supported on the bottom sides thereof by a cross brace 7 extending laterally across the housing 2 and being fastened to the opposide sidewalls thereof. In addition, the other side or top of the legs are engaged by a stop 8 to effectively hold them in a centered position, which stop is secured on the housing 2. The stop 8 is received between the legs of the spring 6. By rotating the screw 3 it is possible to adjust the lengthwise position of the spring member 6 relative to the housing 2. The stop 8 remains stationary and the legs of the spring 6 move therepast.

Figure 3:
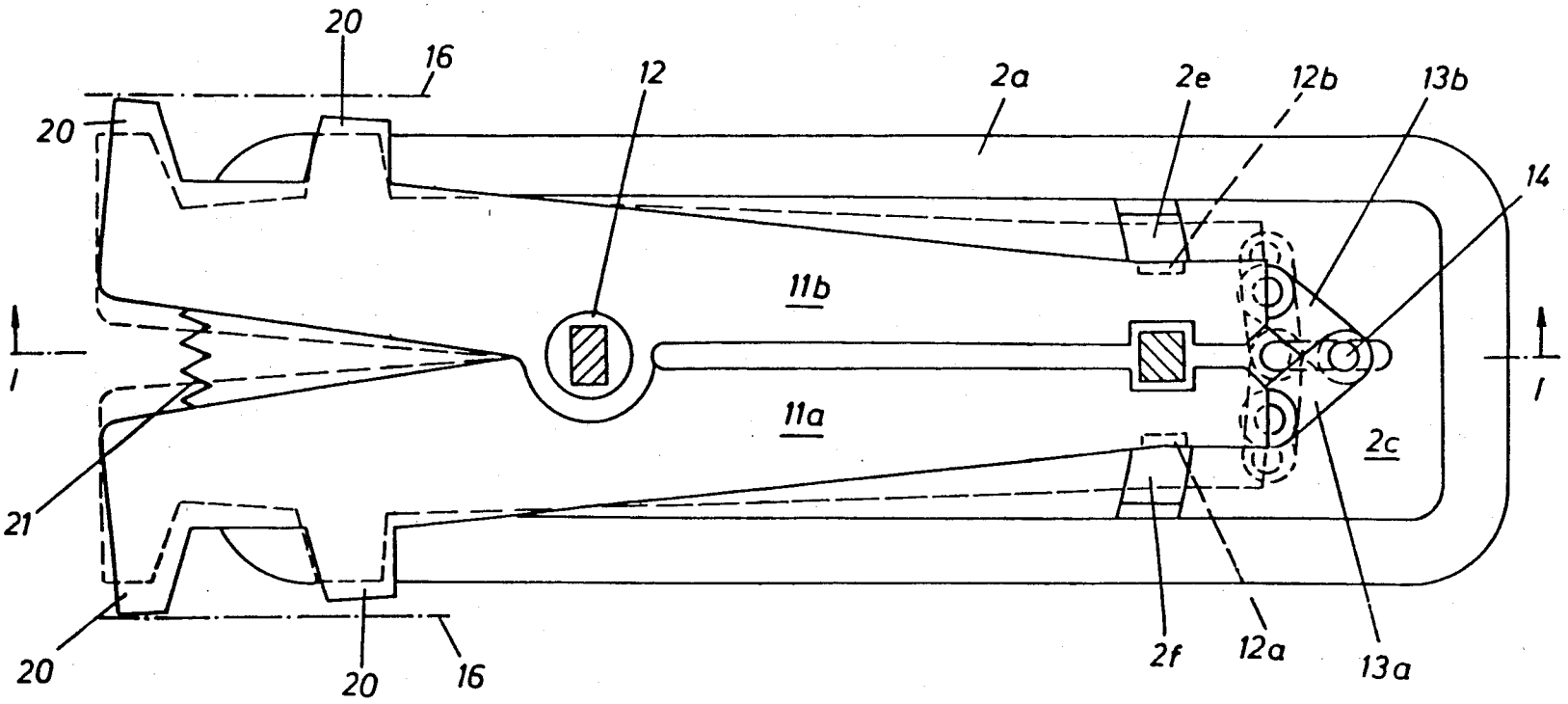
FIG. 3 is a cross-sectional view taken along the line III—III of FIG. 1.
Figure 4:
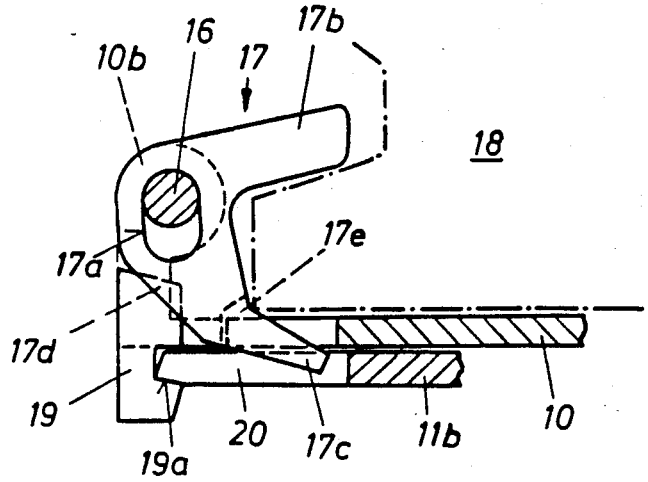
FIG. 4 is an enlarged cross-sectional view taken along the line IV—IV of FIG. 1 and wherein the ski shoe is clamped tightly in the ski binding.

A sliding member 9 extends through a hole in the upper side 2*c* of the housing 2 and between the legs 6*a*, 6*b* of the spring member 6, an enlarged head 9*a* at the lower end of the sliding member being located below the two legs 6*a*, 6*b*. The spring member 6 is manufactured of a low friction material or, if desired, spring steel coated with plastic. The downwardly facing surfaces of the two legs 6*a*, 6*b* are inclined converging upwardly and serve as a bearing surface for the upwardly inclined surfaces 9*b* on the enlarged head 9*a* of the sliding member 9. The upper end of the sliding member 9 projects beyond the upper surface 2*c* of the housing 2, is threadedly secured in a hole in a sole plate 10. There is provided between the sole plate 10 and the upper side 2*c* of the housing 2 two plate-shaped control members 11*a*, 11*b*, one stacked on the other, and which function as two-arm levers (see FIG. 3). Each control member is pivotal about a common and centrally positioned, vertically upright pin 12 secured to the upper side 2*c* of the housing 2. The upper end of the pin 12 has a spherical bearing member 12*c* thereon receiving the sole plate 10 therethrough. Thus, the sole plate can, due to the bearing 12*c*, pivot about both vertical and horizontal axes. Also combined movements of the sole plate 10 about the aforementioned axes are possible. The two control members support, in the region of their ends closest to the tail end of the ski, two downwardly extending bent sections 12*a* , 12*b*, each of which is guided in arc-shaped recesses 2*e*, 2*f* in the upper side 2*c* of the housing. The bent sections 12*a* and 12*b* bear or rest on the laterally outwardly facing side surfaces of the legs 6*a*, 6*b* of the spring member 6. Link members 13*a*, 13*b* are hingedly interconnected by a hinge pin 14 and to the control members 11*a*, 11*b*. The hinge pin 14 is guided in a longitudinally extending slotted hole 2*d* in the upper side 2*c* of the housing 2 and in a correspondingly shaped slot 15*a* in a shoulder 15 thereon. This assures that during a deflection of only one of the two legs 6*a*, 6*b*, the other leg will carry out a mirror image movement in the opposite direction.

The portion of the hinge pin 14 has in the region which is provided immediately above the two link mmebers 13*a*, 13*b* an enlarged cylindrical or square area, through which a bolt 22 extends, the ends of which project laterally outwardly therefrom. The shoulder 15 of the housing 2 supports an upwardly extending block arrangement thereon on which a two-arm release lever 23 is pivotally supported for movement about an axle 23*a*. The uppermost arm of the release lever 23 is to operatively cooperate with the tip of the ski pole or the hand of the skier. The lower arm of the release lever 23 is constructed fork-shaped, and the two fork prongs rest on the ends of the bolt 22.

The sole plate 10 has on its end adjacent to the tip of the ski, and on both lateral sides thereof a pair of upwardly extending bearing blocks 10*a*, 10*b*, longitudinally spaced thereon, and which support a swivel axle 16 therebetween. Each swivel axle extends through a slotted hole 17*a* in an angular clamping jaw 17, the upper lever arm 17*b* of which, in the skiing position, rests on a support surface of the ski shoe 18. The lower lever arm 17*c* has two recesses 17*d* and 17*e* therein, of which the one recess 17*e* is associated with a projection on the sole plate 10. A control plate 19 is guided for movement in the vertical direction between each pair of bearing blocks. The control plate has, on approximately the lower half thereof, a groove 19*a* therein which is open toward the vertical longitudinal center plane of the ski and is approximately trapezoidally shaped in cross section. Projections 20 on the associated control member 11*a* or 11*b* are received in the groove 19*a* when in the skiing position. The control plates 19 are under the influence of springs, which are not illustrated in the drawings, which urge the control plates continually upwardly.

Before the ski binding is put into use, the releasing moment, for example during a frontal fall, must first be adjusted. The nut 5 is, for this purpose, adjusted in the longitudinal direction of the ski by means of the screw 3. This causes, however, the spring member 6 to also be moved, so that the sliding member 9 now engages the leg 6*a*, 6*b* of the spring member at a different point. The effective lever arm of each of the two legs 6*a*, 6*b* is therefore adjusted to correspond to the physical attributes and the skiing capability of the user.

Figure 5:
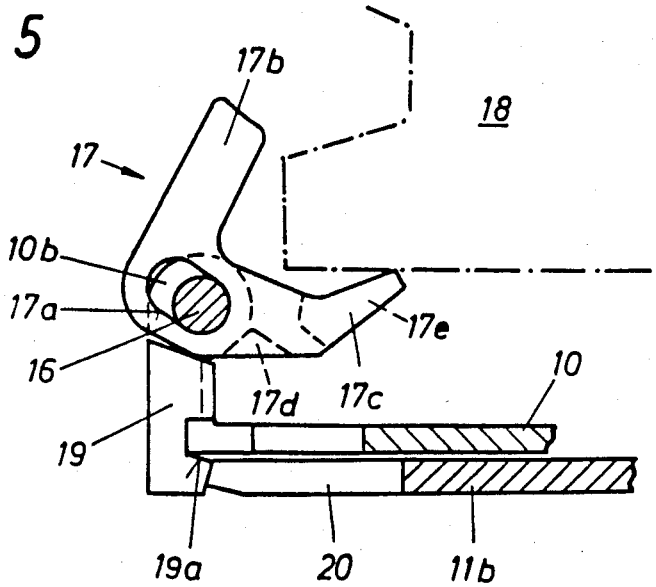
FIG. 5 is the same cross-sectional view as shown in FIG. 4, however, the ski binding is shown in the release position.
Figure 6:
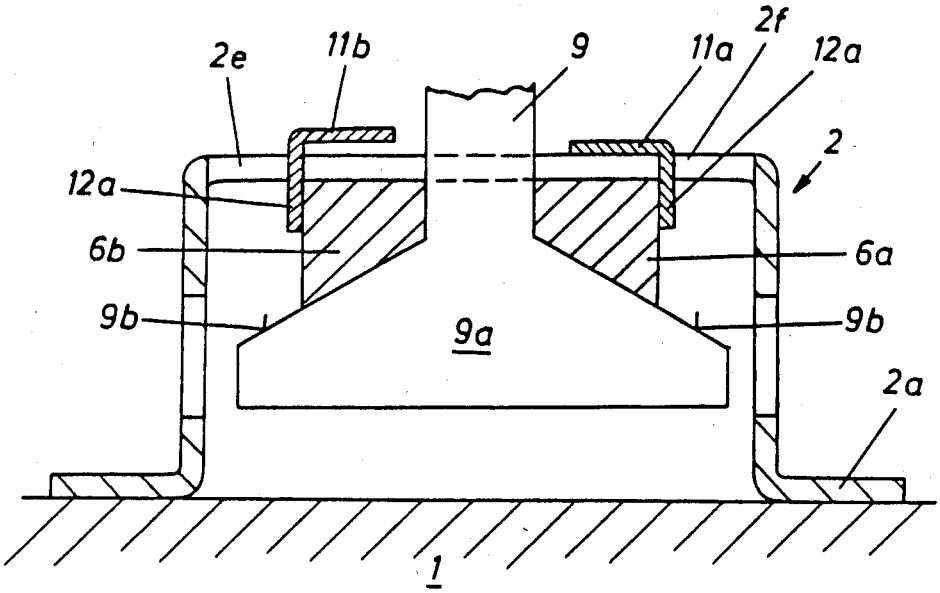
FIG. 6 is an enlarged cross-sectional view taken along the line VI—VI of FIG. 1 in a ski binding which is in the skiing position.

The two clamping jaws 17 are, in the stepping-in position of the ski binding, in the position which is illustrated in FIG. 5. They are held in this position because the upper ends of the control plates 19 are urged against the outer side of the angular clamping jaws 17 by springs (not illustrated). If now the ski shoe 18 is introduced through a movement in vertical direction between the clamping jaws 17, then the two control plates 19 are first moved downwardly against the force of the not illustrated springs, and thereafter the upper ends of the control plates are received in the recesses 17*d* of the clamping jaws 17. Due to the slotted holes 17*a* two clamping jaws 17 slide downwardly, whereby they are held between the sole plate 10, which engages the recesses 17*e*, and the control plates 19, which engage the recesses 17*d*. The two projections 20 on the control members 11*a*, 11*b* are at the same time urged into the grooves 19*a* of the control plates 19 under the influence of an expanding spring 21. This assures that the ski shoe 19 will be clamped tightly, and that the sliding member 9 will be in the position illustrated in FIG. 6.

Figure 7:
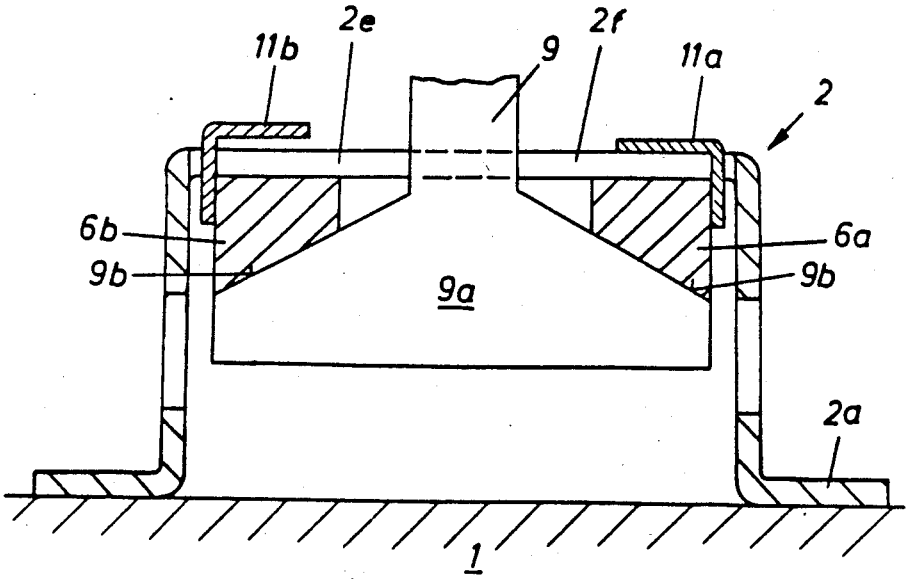
FIG. 7 is the same cross-sectional view as shown in FIG. 6 during a frontal fall of the skier.

If a frontal fall of the skier occurs during skiing, then the sliding member 9 moves into the position illustrated in FIG. 7, in which the two legs 6*a*, 6*b* of the spring member 6 are already urged to the outside. The legs 6*a*, 6*b*, however, have effected during their outward movement an outward movement of the two control members 11*a* and 11*b*, which causes the projections 20 on the control members to be pulled out of the grooves 19*a* in the control plates 19. Now the clamping jaws 17 can be swung to enable the ski shoe 18 to leave the ski binding.

Figure 8:
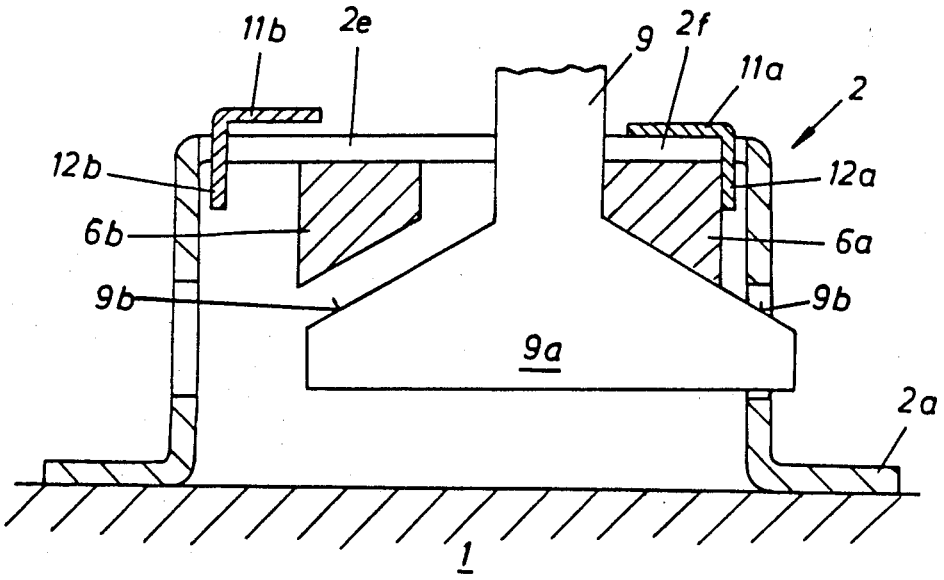
FIG. 8 is again the same cross-sectional view as shown in FIG. 6 during a twisting fall of the skier.

If, however, the skier undergoes during skiing a twisting fall, then the condition illustrated in FIG. 8 occurs. That is, the sliding member 9 is thereby moved laterally toward the side and carries along with its enlarged head 9*a* one leg 6*a* of the spring member 6. The other leg 6*b* of the spring member 6 remains in the rest position, whereat its inner side surface rests on the stop 8 on the upper side 2*c* of the housing 2. The two control members 11*a*, 11*b* behave differently, however. They are, as has already been described, connected with one another through the link members 13*a* and 13*b* and through the hinge pin 14. Thus, if one control member, for example the control member 11*a*, is swung then this results automatically in an analogue swinging of the other control member 11*b* in the opposite direction. However, this assures, in the case of a twisting fall and during which only one of the two legs 6*a* or 6*b* of the spring member is swung, that the projections 20 are pulled out of the grooves 19*a* of the control plates 19 on both sides of the longitudinal center plane of the ski to effect an opening of the clamping jaws 17.

Of course, the releasing moment is substantially smaller during a twisting fall than during a frontal fall. This, on the one hand, is due to the fact that during a twisting fall only one of the two legs 6*a*, 6*b* of the spring member 6 are swung and, on the other hand, is due to the fact that during a twisting fall the full force is transmitted onto the leg, whereas during a frontal fall only the horizontal components of the force, which in the normal plane acts onto the upper side of the ski, is utilized for swinging the two legs 6*a*, 6*b* of the spring member 6, which components operate through the two inclined surfaces 9*b* on the head 9*a* of the sliding member 9.

In order to voluntarily open the inventive release binding, the release lever 23 is swung clockwise for example with the tip of the ski pole. This causes the hinge pin 14 to be moved in the slotted hole 2*d* in the upper side 2c of the housing and in the slot 15*a* in the shoulder 15 of the housing 2 in a direction toward the tip of the ski. This results in a swinging apart of the link members 13*a* and 13*b* and of the control members 11*a* and 11*b*. This causes, however, the projections 20 of the control members 11*a* and 11*b* to be pulled out of the grooves 19*a* in the control plates 19 so that the clamping jaws 17 can be swung outwardly and the ski shoe 18 can leave the ski binding.

Figure 9:
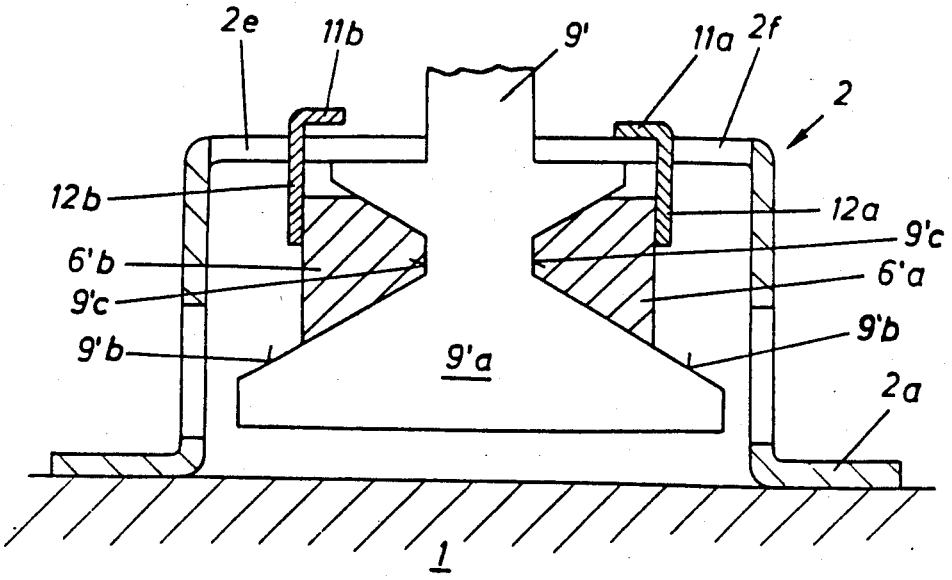
FIG. 9 illustrates a second exemplary embodiment, namely in cross section taken along the line VI—VI of FIG. 1.

FIG. 9 illustrates one embodiment which can be opened also during a fall backward. The enlarged head 9'a of the sliding member 9' has for this purpose, and on both sides thereof, a laterally outwardly facing groove 9'c, which in cross section is wedge-shaped and which is defined on one side by an inclined surface 9'b. In the engaged or skiing position, the correspondingly formed legs 6'a, 6'b of a spring member 6' are received therein. Bent sections 12a and 12b of the control members 11a, 11b again rest on the outer sides of the leg 6'a and 6'b.

The operation of this ski binding corresponds during frontal and twisting falls with the operation of the first discussed embodiment. However, if a fall to the rear takes place, then the downwardly facing wedge surfaces on the head 9'a of the sliding member 9' starts to function. The downwardly facing wedge surfaces effect a moving of the ends of the two legs 6'a, 6'b of the spring member 6' laterally outwardly away from the longitudinal center plane of the ski which, as stated above, results in an opening of the clamping jaws 17 and thus effects a release of the ski shoe 18.

Of course the invention is by no means to be limited to the exemplary embodiments which are illustrated in the drawings and which are described above. Rather, various modifications of the same are possible without departing from the scope of the invention. For example, it would also be possible to provide in place of a pressure spring, which urges the arms of the control members to the outside and are adjacent to the clamping jaws, a torsion spring serving the same purpose. Furthermore, it is not absolutely necessary to support the sole plate in a toggle joint on the ski-fixed housing. Rather, embodiments are also possible, in which the vertical and the horizontal swivel axis are offset with respect to one another in the longitudinal direction of the ski-fixed housing.

The embodiments of the invention in which an exclusive property or privilege is claimed are defined as follows:

1. In a release ski binding comprising an elongate sole plate adapted to be pivotally supported on a ski for movement about a vertical axis and about a transverse axis, which sole plate in the skiing position is held on the ski by a resilient holding mechanism so that a longitudinal axis of said sole plate is parallel to a longitudinal axis of the ski, said resilient holding mechanism being response to a movement of the sole plate relative to the ski and about at least one of said vertical and horizontal axes so that upon reaching a predetermined angle of traverse, effects an opening of a locking mechanism, the improvement comprising wherein said resilient holding mechanism is formed by a U-shaped spring member having a bearing thereon arranged in the region whereat the legs of the U are joined together, wherein support means are provided for supporting said spring member for selective adjustable movement in the longitudinal direction of the ski with respect to said locking mechanism, wherein a sliding member is secured to and movable with said sole plate and is arranged between the legs of the U and wherein said slide member has an enlarged head thereon, said head having two upwardly converging surfaces each slidingly engaging correspondingly formed surfaces on the underside of each of the two legs of said spring member.

2. The ski binding according to claim 1, wherein support means for adjusting the position of said spring member includes a pin secured to said spring member, said pin being supported on a travelling nut arranged on a rotatably supported screw which extends in the longitudinal direction of the ski.

3. The ski binding according to claim 2, wherein a housing is provided, in which is housed said spring member, and wherein said screw is rotatably supported at its end which is remote from said nut on a wall of said housing, said screw being secured against axial movement relative to said housing, said housing being secured to the upper surface of the ski and oriented below said sole plate.

4. The ski binding according to claim 3, wherein for rotatably supporting said screw a flange is provided on said screw and a groove is provided on said screw on a side of said wall of said housing remote from said flange, and wherein a snap ring is received into said groove.

5. The ski binding according to claim 3, wherein said screw at its end which projects from said housing is provided with a noncircular end to facilitate engagement by a tool.

6. The ski binding according to claim 1, wherein said spring member is supported in the region adjacent the free ends of its legs on a cross brace.

7. The ski binding according to claim 1, wherein a housing is provided, and wherein said spring member is centered in the skiing position of the ski binding with respect to the vertical longitudinal center plane by a stop secured on said housing, which stop extends between the free ends of the two legs of said spring member.

8. The ski binding according to claim 1, wherein said slide member has two downwardly converging surfaces each opposing an adjacent upwardly facing surface to define a groove therebetween which is wedge-shaped in cross section, in which groove in the skiing position is received a correspondingly formed leg of said spring member, which leg is approximately trapezoidal in cross section.

9. The ski binding according to claim 1, wherein said support means includes a housing, and wherein between the underside of the said sole plate and the upper side of said housing there are arranged two two-arm plate-shaped and pivotally supported control members, said control members being pivotal about an axis of a pin secured to the upper side of said housing, and one arm of each two-arm control member being operatively coupled to a respective one of the two legs of said spring member.

10. The ski binding according to claim 9, wherein an arm of each said control member adjacent the legs of said spring member, have downwardly extending, bent section extending through arc-shaped recesses in said upper side of said housing and engage the outwardly facing sides of said two legs of said spring member.

11. The ski binding according to claim 10, wherein a spring means is provided for urging said bent sections of said two control members together.

12. The ski binding according to claim 11, wherein link members are hingedly connected to said arms of said control members having said bent sections thereon, said link members being interconnected a hinge pin guided in a slotted hole in said upper side of said housing and in a slot in a shoulder on said housing.

13. The ski binding according to claim 1, wherein said locking mechanism includes, at an end of said sole plate closest the tip of the ski, two pairs of bearing blocks located adjacent the lateral edges of said sole plate, on which bearing blocks pivot axles are secured, on which pivot axles are arranged angularly shaped clamping jaws having slotted holes therein.

14. The ski binding according to claim 13, wherein a pair of two-arm control members are each pivotally supported, each having one arm operatively coupled to a respective one of the two legs of said spring member, wherein between each pair of said bearing blocks there is guided a control plate for movement in the vertical direction, which control plate has in its lower half a groove which is open toward the vertical longitudinal center plate of the ski and is approximately trapezoidal in cross section, and wherein at least one projection is arranged on each control member, which in the skiing position of the ski binding is received in said groove.

15. The ski binding according to claim 14, wherein each clamping jaw has a clamping arm and a lower lever arm, and wherein two recesses are provided on said lower lever arm remote from said clamping arm, one of which recesses serves, in the skiing position of the ski binding, to receive a projection on said sole plate therein and the other one to receive an upper end of said control plate therein.

16. The ski binding according to claim 14, wherein each control plate is under the influence of a spring which urges said control plate upwardly.

17. The ski binding according to claim 14, wherein each clamping jaw has an outer surface which extends approximately parallel with respect to the longitudinal axis of said slotted hole in said clamping jaw, which outer surface serves as a bearing surface for said upper end of an associated control plate when said clamping jaw is in the stepping-in position of the ski binding.

18. The ski binding according to claim 12, wherein said hinge pin has in the region above said two link members an enlarged portion, through which extends a bolt extending in the transverse direction of the ski and laterally beyond said enlarged portion, and wherein a bearing block is provided on said shoulder and wherein there is arranged an axle on said bearing block on which is supported a two-arm release lever having a lower, U-shaped constructed arm which rests on the ends of said bolt.

* * * * *

UNITED STATES PATENT AND TRADEMARK OFFICE

CERTIFICATE OF CORRECTION

PATENT NO. : 4 598 928

DATED : July 8, 1986

INVENTOR(S) : Vladimir Konwitza

It is certified that error appears in the above-identified patent and that said Letters Patent is hereby corrected as shown below:

Column 8, line 53; change "section" to ---sections---.

Column 9, line 12; change "plate" to ---plane---.

Signed and Sealed this

Twenty-first Day of October, 1986

[SEAL]

*Attest:*

DONALD J. QUIGG

*Attesting Officer*

*Commissioner of Patents and Trademarks*